United States Patent [19]

Finnemore

[11] 3,998,266

[45] Dec. 21, 1976

[54] COMPARTMENT SUPPORT FOR VERTICAL SHAFT AIR PREHEATER

[75] Inventor: Harlan E. Finnemore, Wellsville, N.Y.

[73] Assignee: The Air Preheater Company, Inc., Wellsville, N.Y.

[22] Filed: Apr. 14, 1975

[21] Appl. No.: 568,340

[52] U.S. Cl. ..... 165/8; 165/10

[51] Int. Cl.[2] ..... F28D 19/04

[58] Field of Search ..... 165/8, 10

[56] References Cited

UNITED STATES PATENTS

| | | | |
|---|---|---|---|
| 3,572,425 | 3/1971 | Brandt et al. | 165/10 X |
| 3,710,851 | 1/1973 | Finnemore | 165/10 X |
| 3,891,029 | 6/1975 | Mahoney | 165/8 |

*Primary Examiner*—C. J. Husar
*Attorney, Agent, or Firm*—Wayne H. Lang

[57] ABSTRACT

An arrangement for a rotary regenerative heat exchanger in which sector-shaped compartments containing a mass of heat absorbent material are pivotally connected to a central rotor post that is disposed about a vertical axis. The pivotal arrangement includes an independent spherical bearing which is trapped between confronting cavities that lie intermediate the rotor post and a radially adjacent basket to provide a limited degree of universal movement therebetween.

7 Claims, 4 Drawing Figures

COMPARTMENT SUPPORT FOR VERTICAL SHAFT AIR PREHEATER

BACKGROUND OF THE INVENTION

1. Field of the Invention

The present invention relates to rotary regenerative heat exchangers that comprise a series of sector-shaped baskets of heat absorbent material that are supported in radial juxtaposition around a central rotor post. More specifically, the invention relates to a simple but unique arrangement for pivotally supporting the baskets about a vertical rotor post in a manner that permits them to be subjected to thermal expansion and contraction independent from the rotor post whereby the rotor baskets and the rotor post are both free to expand and contract without impairing the structural integrity of the connection therebetween.

2. Description of Prior Art

Various arrangements for the pivotal support of heat absorbent element outward from central rotor post have been developed because such pivotal support has been accepted as an optimum arrangement for eliminating breakage of connecting links between parts being subjected to a differential of expansion.

U.S. Pat. No. 3,710,850 issued on Jan. 16. 1973, shows a rotary regenerative heat exchange apparatus including a series of sector-shaped baskets of heat absorbent element that are supported outward from a horizontal rotor post on pivotal connections that essentially comprise "universal" type joints, while U.S. Pat. No. 3,710,851 issued on Jan. 16, 1973, is directed to a specific "ball-and-socket" arrangement in which the ball is connected to a basket and then positively clamped between hemispherical depressions carried by a horizontal rotor post whereby the baskets and the rotor post may expand and contract independently.

Thus, pivotal support arrangements that permit relative movement between a horizontal rotor post and the rotor that depends therefrom have been developed; however, they are relatively complex arrangements that have limited strength characteristics and most importantly, they are limited to a rotor post that is disposed about a horizontal axis.

SUMMARY OF THE INVENTION

This invention provides an arrangement by which a series of independent sector-shaped baskets of heat absorbent elements are pivotally carried by ball-and-socket joints that are disposed about a vertical rotor post. The arrangement moreover provides a ball-and-socket pivotal connection between the rotor post and baskets of heat absorbent element that dispenses with brackets holding the pivotal connection outwardly therefrom to produce a lever arm subject to the force of bending. Inasmuch as the device of this invention is not subject to a bending force, the pivoted joint is subject only to the forces of tension, compression, and shear that traverse the ball. Therefore, the physical requirements of the pivotal connection are greatly simplified, and a significant economy of material and cost of manufacture is achieved.

BRIEF DESCRIPTION OF THE DRAWING

Other objectives and means of operation will become more apparent from the specification and the accompanying drawing in which.

DESCRIPTION OF A PREFERRED EMBODIMENT

Figure 1:
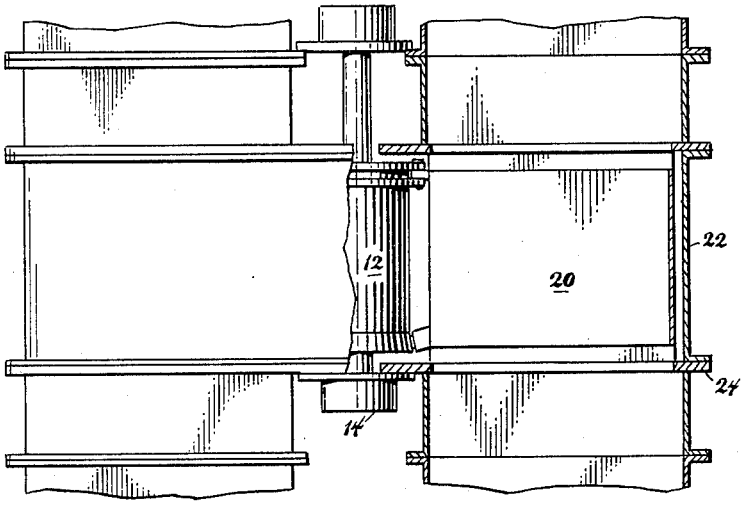
FIG. 1 is a sectional elevation of a rotary heat exchanger made in accordance with this invention.

The arrangement of the drawing shows a rotary regenerative heat exchanger having a rotor post 12 supported in bearing 14 for rotation about its vertical axis. The rotor contains a mass of heat absorbent element 16 that is slowly moved about the axis of the rotor to alternately subject the heat absorbent element to a stream of heating fluid and a stream of fluid to be heated.

The heat absorbent material is carried in a plurality of adjacent compartments 18 that are pivotally attached to the rotor post so as to comprise an integral rotor. The rotor is surrounded by a housing 22 having end plates 24 at spaced ends thereof formed with openings that simultaneously direct a hot fluid and a cold fluid through spaced compartments of the rotor.

The usual way of connecting the rotor compartments to the rotor post comprises making a conventional welded joint therebetween. However, such a rigid joint is unsatisfactory because when subjected to extreme temperature variations there will result a differential of expansion, potential cracking, and separation which leads to fluid leakage and a lowered efficiency.

It has been determined that pivotal joints of ball-and-socket type are uniquely adapted to provide a universal coupling between the element basket and the rotor post, whenever the rotor is disposed about a horizontal axis. When, however, the rotor post is disposed about a vertical axis, pivotal joints used to secure rotor compartments to the rotor post are subject to a constant bending stress and the baskets are subject to excessive axial movement so the usual types of pivotal joints are not satisfactory for use with a vertical rotor.

This invention, therefore, provides a close coupled pivotal joint that permits sufficient relative movement between the rotor post and an element basket that depends therefrom to permit limited thermal adjustment while is precludes excessive relative movement that would lower its efficiency of operation. Specifically, the pivotal joint for a vertical rotor comprises a convention tension joint at the top of the rotor and a ball-and-socket type compression fitting at the bottom end of the rotor post.

In accordance with this invention, I provide an arrangement whereby each compartment is pivotally held outward from the vertical rotor post. An upper tension fitting pivotally holds each compartment in tension to the rotor post while a lower fitting is in a continuous state of compression to maintain the rotor compartment at all times in a given position outward from the rotor post.

Figure 2:
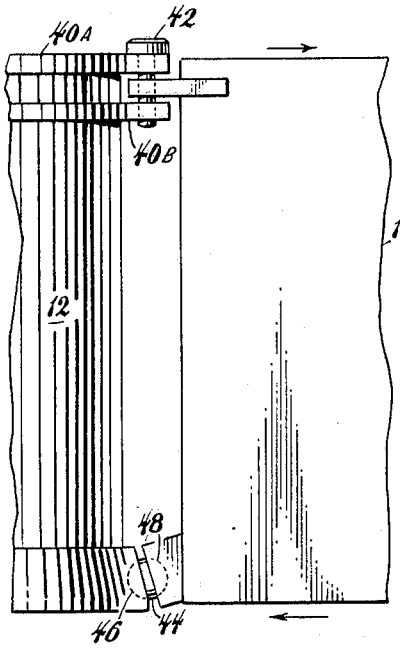
FIG. 2 is a partial side elevation of an arrangement for attaching an element basket to a rotor post.
Figure 3:
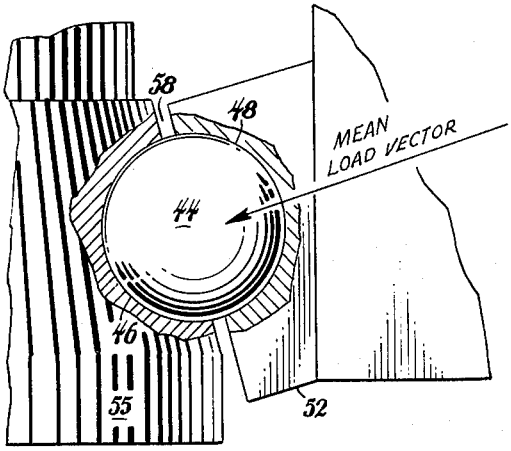
FIG. 3 is an enlarged cross-sectional view showing the details of a typical ball-joint.
Figure 4:
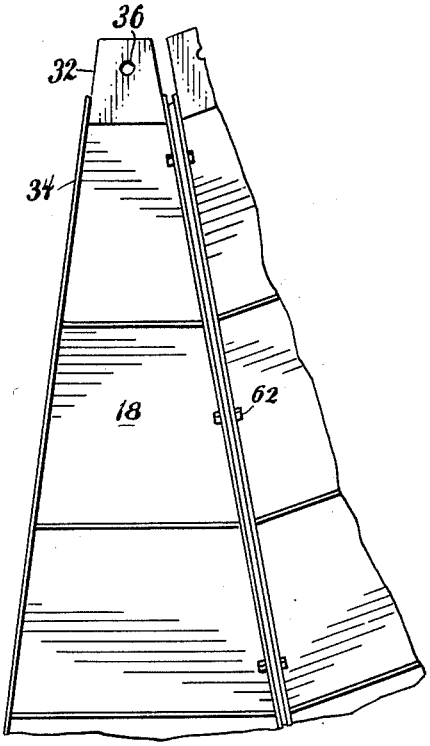
FIG. 4 is a plain view of a plurality of adjacent sector-shaped compartments.

The upper or tension fitting includes a web portion 32 that is secured between radial extending sides of each compartment. It then projects radially inward and is provided with an axially disposed aperture 36 that vertically coincides with apertures of the flanges 40A and 40B on the rotor post. After the apertures are aligned they may be readily linked together by a pin 42 inserted at the top of the rotor in accordance with FIG. 2.

The ball-and-socket joint includes a spherical member or key 44 which is trapped between hemispherical depressions 46 and 48 formed in the rotor post and in the confronting face of the adjacent radial compartment. The spherical key 44 is entirely free and independent so it cannot be subjected to tension or a bending force; therefore, it is only subject to the forces of compression and shear. Inasmuch as the upper connection is held in continuous tension, the lower connection is held under continuous compression that results in a force directed radially inward. Simultaneously the dead weight of compartment 18 and the element therein produces a vertically downward shear force upon the spherical key. This force is combined with the radial compressive force as single load vector acting through the center of the ball joint.

To provide an optimum bearing surface the spherical key 44 fits between depressions 46 and 48 formed in a surface of contronting collars 52 and 55. The collar 55 includes a series of plane faces 58 that confront one of the adjacent baskets outward therefrom.

Each force of the support hub 58 is perpendicular to the load vector that is being transmitted thereto by each element basket. Thus, the face 58 would be inclined from the vertical, an amount dependent upon the physical characteristics of each basket. Moreover, a less than hemispherical depression 46 would be formed therein to hold the spherical key.

A socket block 52 would be made integral with each compartment outward from the hub 55 and it would be integrally secured thereto as by welding wherein a plane face would be substantially parallel to the inclined face 58 of the support hub. A hemispherical depression 48 similar to that at 46 would be formed therein and the spherical key entrapped therebetween to permit limited pivotal movement but to preclude axial movement.

When assembling a unit of the type herein disclosed, the spherical key 44 or bearing is first inserted into the hemispherical cavity 46 in the hub where its center of gravity lies within said cavity so as to attain a state of equilibrium therein. If said spherical key is not naturally held in its depression, it may be coated with a tacky material, lubricated with a highly viscous grease or even attached temporarily thereto by a weak adhesive so that it held temporarily in position. A sectorial compartment 18 is then lifted into position with the depression 48 thereof superposed over the spherical bearing 44. While the lifting apparatus holds the rotor compartment on the spherical bearing, the opening of the flange 40A is aligned with opening 36 in the spaced flange 32 and then linked together with a tension pin 42 inserted from above.

A second rotor compartment is then similarly installed at a point on the periphery of the rotor post which is removed 180° from the compartment originally installed. Subsequent compartment originally installed. Subsequent compartments are then alternately installed on opposite sides of the rotor post and connected by bolts 62 until a series of compartments extend fully around the rotor post.

Thus, a trapped ball-type pivotal joint supporting a basket of heat absorbent element outward from a vertically disposed rotor post has been disclosed; however, it is intended that equivalent support means should be substituted therefore without resorting to invention. It is, therefore, intended that all material shown in the accompanying drawing or described in the accompanying specification shall be interpreted as illustrative and not in a limiting sense.

I claim:

1. Rotary regenerative heat exchange apparatus having a rotor post disposed about a vertical axis, a plurality of essentially sector-shaped baskets arranged in lateral juxtaposition around the rotor post to comprise an annular rotor, a mass of heat absorbent material carried in the compartments of the rotor, housing means surrounding the rotor and having end plates with openings that permit a heating fluid and a fluid to be heated to flow through the rotor, means for rotating the rotor about its vertical axis to align the heat absorbent material of the rotor alternately with the heating fluid and the fluid to be heated, a pivotal linkage connecting the upper end of each sector-shaped basket to the rotor post, a support surface on said rotor post subjacent said pivotal linkage disposed radially inward from each sector-shaped basket and formed to include a substantially hemispherical depression, a surface having a similar depression formed therein on each basket confronting said rotor post, and an independent spherical key trapped between confronting hemispherical depressions adapted to support the rotor and permit pivotal movement between the rotor baskets and the vertical rotor post.

2. Rotor regenerative heat exchange apparatus as defined in claim 1 wherein the diameter of the spherical key does not exceed the diameter of the confronting hemispherical depressions.

3. Rotary regenerative heat exchange apparatus as defined in claim 1 wherein the diameter of the spherical key is greater than the sum of the depths of confronting hemispherical depressions.

4. Rotary regenerative heat exchange apparatus as defined in claim 3 wherein the support surface on said rotor post and the contronting surface on the sector-shaped compartments are similarly inclined at spaced sides of the spherical key to form surfaces that may be moved obliquely with respect to one another.

5. Rotary regenerative heat exchange apparatus as defined in claim 4 wherein the center of gravity of said spherical key is superposed over a radially adjacent hemispherical depression formed in a contronting surface of the rotor post.

6. Rotary regenerative heat exchange apparatus as defined in claim 1 wherein the spherical key is free and independent from the hemispherical depressions formed in the confronting surfaces of the rotor post and the rotor baskets.

7. Rotary regenerative heat exchange apparatus as defined in claim 1 wherein the spherical key seated in a spherical depression of the rotor post combines a plurality of loads into a single load vector that acts through the center of the spherical key.

* * * * *